US007384898B2

(12) United States Patent
Koshti et al.

(10) Patent No.: US 7,384,898 B2
(45) Date of Patent: Jun. 10, 2008

(54) AQUEOUS COMPOSITION OF A BETAINE WITH SOLIDS CONTENT OF AT LEAST 45% BY WEIGHT

(75) Inventors: Nirmal Madhukar Koshti, Maharashtra (IN); Bharat Bhikaji Parab, Maharashtra (IN); Subhash Shivling Nashte, Maharashtra (IN)

(73) Assignee: Galaxy Surfactants Limited, Pawne, Navi Mumbai ( * ) Notice: Subject to any disclaimer, the term of this patent is extended or adjusted under 35 U.S.C. 154(b) by 418 days.

(21) Appl. No.: 11/010,762

(22) Filed: Dec. 13, 2004

(65) Prior Publication Data

US 2006/0128596 A1 Jun. 15, 2006

(51) Int. Cl.
*C11D 1/90* (2006.01)
*C11D 3/20* (2006.01)
*C11D 3/33* (2006.01)

(52) U.S. Cl. ..... 510/123; 510/136; 510/137; 510/159; 510/499

(58) Field of Classification Search ..... None
See application file for complete search history.

(56) References Cited

U.S. PATENT DOCUMENTS 4,497,825 A * 2/1985 Bade ..... 514/556
5,099,065 A * 3/1992 Kubo et al. ..... 562/564
5,354,906 A * 10/1994 Weitemeyer et al. ..... 554/52
5,908,617 A * 6/1999 Moore et al. ..... 424/70.19
6,582,687 B1 * 6/2003 Hamano et al. ..... 424/78.03
2003/0171229 A1 * 9/2003 Gonzalez et al. ..... 510/123

* cited by examiner

*Primary Examiner*—Gregory R Del Cotto
(74) *Attorney, Agent, or Firm*—Akerman Senterfitt; Gregory M. Lefkowitz

(57) ABSTRACT

An aqueous composition comprising solution of a betaine of the following general Formula I is disclosed Formula I Formula I

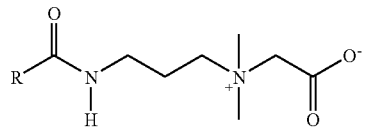

in which R is an alkyl group of coconut fatty acids, preferably hydrogenated coconut fatty acids, or a fatty acid mixture which, on the average, corresponds to coconut fatty acids, wherein the solution has a solids content of at least 45% by weight, a pH of 4.5 to 8, an amidoamine content of not more than 1% by weight, and a free fatty acid content less than 1% by weight, an N-acyl α-aminoacids content between 0.5 to 3% by weight and 0 to 4% by weight of glycerin, based on the solution.

14 Claims, No Drawings

AQUEOUS COMPOSITION OF A BETAINE WITH SOLIDS CONTENT OF AT LEAST 45% BY WEIGHT

BACKGROUND OF THE INVENTION

Alkyl amidopropyl betaines in general and cocoamidopropylbetaine (CAPB, CAS 61789-40-0) in particular are known for their mildness and hence are very widely used in personal care and consumer products ["*Encyclopedia of conditioning rinse ingredients*" ed. A. L. L. Hunting, Micelle Press, London (1987), p. 125].

As a result of their superior performance, biodegradability and low toxicology profile, they are used on huge scale in cosmetic industry [X. Domingo, "*Amphoteric Surfactants*" ed. E. G. Lomax, Surfactant Science Series, Marcel Dekker Inc., New York, (1996), Vol. 59, p. 75 and J. G. Weers, J. F. Rathman, F. U. Axe, C. A. Crichlow, L. D. Foland, D. R. Scheuing, R. J. Wiersema and A. G. Zielske, Langmuir, 7, 854-867, (1991)].

A conventional commercial betaine composition typically has the following compositions:

| | |
|---|---|
| Water | 64% by weight |
| Betaine | 28-29% by weight |
| NaCl | 5-6% by weight |
| Glycerin | 0.3% by weight |
| Fatty acid | 0.5% by weight |
| Amidoamine | ca. 0.3% by weight |
| Total solids content | ca. 36% by weight |

The solids content represents the sum of the components other than water. The proportions of betaine and sodium chloride arise out of the stoichiometry of the reaction of the fatty amide with tertiary amino group (amidoamine) and sodium chloroacetate according to the equation given below.

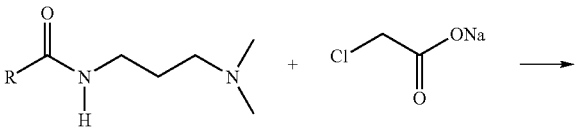

Formula II

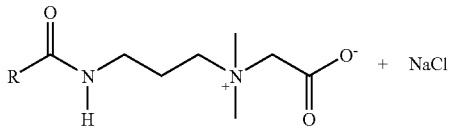

Formula I

A small amount of amidoamine normally remains in the product because the quaternization reaction is incomplete. This proportion can, however, be further reduced by an adapted stoichiometry and reaction procedure. The further typical components like glycerin and fatty acids listed originate from the synthesis of the amidoamine. Small amounts of fatty acids (0.5%) in the betaine composition results from synthesis of amidoamine from the corresponding fatty acid and 3-N,N-dimethylaminopropylamine. Glycerin is present in the betaine composition if the amidoamine is synthesized from triglycerides (coconut or palm oil) and 3-N,N-dimethylaminopropylamine.

It is well known that composition of betaines of the aforementioned type is liquid only below a particular concentration of total solids. For example, at ambient temperature a composition of a betaine of Formula I derived from coconut fatty acids solidifies at a solids content of about 40% by weight. For this reason, conventional, commercial, aqueous solutions of coconut amidopropylbetaine, derived from coconut fatty acids, have total solids concentrations below 40% by weight and in most cases about 35-36% by weight. The maximum achievable concentration of a flowable solution of a betaine decreases as the number of carbon atoms is increased. If the fatty acid mixture contains a higher proportion of unsaturated fatty acids, the concentrations achievable frequently are comparatively higher than those achievable with saturated fatty acids.

Several attempts have been made to create betaines (Formula I) of higher concentration primarily because it has been shown that aqueous betaine composition of higher concentrations is self-preserving. The second obvious motive for preparing betaines of higher concentration is low cost of transportation. U.S. Pat. No. 4,243,549 (1981) describes preparation of high active betaines (33.5% by weight) by blending equivalent amount of ethoxylated alkyl sulphate, the anionic surfactant. Flowable and pumpable high active betaines are reported in German patent DE 3613944. The synthesis described in this patent involves use of solvent and azeotropic removal of water. Another German patent DE 3726322 reveals use of highly acidic pH to create betaines of higher concentration. Use of 3 to 20% by weight of nonionic surfactant is taught by German patent DE 3826654 for making betaines of higher concentration. Reference is made to U.S. Pat. No. 5,354,906 (1994) according to which upto 36% by weight active betaines are produced by addition of 1 to 3% by weight of fatty acids. This results in overall solids content of at least 40% by weight [DE 4207386 (1993); EP 560114 (1993)]. DE 19523477 reports the process of making betaines with active content of 40 to 45% by weight using quaternised salts of tertiary amidoamines that are synthesized from 3-N,N-dimethylaminopropylamine and polycarboxylic acids. Flowable betaines of total solids content of 40-55% by weight are made by incorporation of 1 to 10% by weight of hydroxy carboxylic acids [DE 4408183]. Finally, inclusion of mixture of fatty acids and ethoxylated cocomono glycerides also result in achieving betaines of high activity [DE 4408228].

Thus, it makes sense to create industrially feasible alkylamidopropylbetaines (Formula I) of higher concentration to save on freight charges and to render them self-preserving. The self-preserving nature of high active betaines has been established by performing 'preservation loading test' using various types of micro organisms [U.S. Pat. No. 5,354,906 (1994)]. It is an object of the present invention to provide a high active aqueous betaine composition comprising a betaine of the general Formula I with less than 5.0 ppm of free sodium monochloroacetate, a totally undesirable impurity.

It is an object of the present invention to provide a process for preparing a high active aqueous betaine composition comprising a betaine of the general Formula I which obviates steps like filtration, concentration and use of organic solvents for making high active betaines.

It is a further object of the present invention to provide an aqueous betaine composition comprising a betaine of the general Formula I which is self-preserving.

SUMMARY OF THE INVENTION

The present invention provides an aqueous betaine composition comprising a betaine of the general Formula I, Formula I

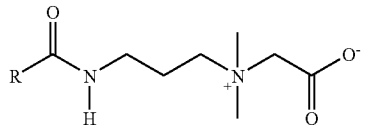

in which R is an alkyl group of coconut fatty acids, preferably hydrogenated coconut fatty acids, or a fatty acid mixture which, on the average, corresponds to coconut fatty acids, an amidoamine of not more than 1% by weight, a free fatty acid less than 1% by weight, 0 to 4% by weight of glycerin, based on composition, less than 5 ppm of free sodium monochloroacetate and, 0.5 to 3% by weight of N-acyl α-amino acids of Formula III wherein R' is selected from saturated or unsaturated alkyl group with carbon atoms from 8 to 20 and R" is selected from H, methyl, ethyl or phenyl, wherein the composition has a solids content of at least 45% by weight and a pH of 4.5 to 8.

More particularly, the invention relates to aqueous betaine composition comprise a betaine of the aforementioned type with a solids content of at least 45% by weight, 0.5 to 3% by weight of N-acyl α-amino acids and free sodium monochloroacetate content of less than 5.0 ppm. The solids content is defined as the weight which is determined by evaporating sample on a flat glass dish for 2 hours at 105° C.

In the present invention, the high active betaines with solids content of at least 45% by weight are obtained by addition of N-acyl α-amino acids of Formula III to the extent of 0.5 to 3% by weight based on the composition.

Formula III

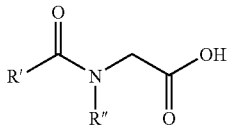

N-Acyl α-aminoacids of Formula III, wherein R' is selected from saturated or unsaturated alkyl group with carbon atoms from 8 to 20 and R" is selected from H, methyl, ethyl or phenyl.

The high active, self-preserving betaine composition of the present invention is a clear aqueous solution that is pourable and flowable at ambient temperatures. The trace level impurities of 3-N,N-dimethylaminopropylamine and sodium monochloroacetate are less than 5.0 ppm.

DETAILED DESCRIPTION OF THE INVENTION

Alkylamidopropylbetaines are produced by quaternizing the alkylamindopropylamine of Formula II with stoichiometric quantity of sodium monochloro acetate in aqueous medium. The alkylamidopropylamine can be obtained by reacting stoichiometric amounts of fatty acids with 3-N,N-dimethylaminopropylamine or aminolysis of triglycerides with the same amine. Either route works very well and the amidification is normally done at 130-140° C. Depending upon the fatty raw material used the amidoamine of Formula II may contain small amounts of unreacted triglyceride or fatty acids usually around 1% by weight. The amidoamine generated from triglyceride obviously has stoichiometric quantities of glycerin liberated. In the present invention the quaternization of amidoamine of Formula II is done by reacting 1.0 mole with amidoamine with 1.05 to 1.08 mole of sodium monochloroacetate at the temperature of 80-85° C. while maintaining pH between 7.5-8.0 by adding sodium hydroxide solution (45%). The progress of the reaction is monitored by estimating the chloride ion liberated as well as by estimating the unreacted amidoamine. Both analytical parameters ensure the completion of quaternization with free amidoamine around 0.5% by weight. Determination of free amidoamine from aqueous betaine composition is done by extracting and then titrating it against standard acid using potentiometry. The amidoamine is extracted from aqueous betaine composition and then it is determined by titrating against acid using potentiometry. N-acyl α-aminoacid (0.5 to 3% by weight) is added to the reaction mass with the solids content above 45% by weight at 85° C. and the pH is raised to 10-10.5 at 95° C. for four hours. This step is essential for destruction of unreacted sodium monochloraceate and to ensure that free sodium monochloroacetate is less than 5.0 ppm. Free sodium monochloroacetate content was determined by ion chromatography of the solid phase extracted betaine composition using anion exchange column. Finally, the pH of the reaction mass is adjusted to 4.5 to 6.5 by mineral acid and is then cooled while stirring. Adjustment of solids content to at least 45% gives clear, flowable betaine composition. The betaine composition thus obtained has 0.5 to 3% of N-acyl α-aminoacid by weight and betaine content of minimum 35% by weight. The betaine composition thus obtained has cloud point above 40° C. and solidification point ranges between 5 to −10° C. The significance of cloud point is that the product remains clear liquid over a wide range of temperatures that covers the entire globe.

The N-acyl α-aminoacids that are used in the present invention to obtain high active betaines are of Formula III, wherein R' is selected from saturated or unsaturated alkyl group with carbon atoms from 8 to 20 and R" is selected from H, methyl, ethyl or phenyl. N-acyl α-aminoacids, particularly in the form of their sodium salts, are widely used because of their outstanding mildness to skin and eyes and biodegradability. They are compatible with cationic as well as amphoteric surfactants and find applications in shampoos, mouth washes and medicated skin cleansers [Spivack, J. D., 'Anionic Surfactants' edited by Linfield, W. A., Marcel Dekker New York, 1976, 561-617 and technical literature titled 'Hamposyl Surfactants' by Hampshire, Organic Chemicals Division, Texas, USA]. Hence N-acyl α-aminoacids are useful additives compared to the additives that are mentioned in the prior art to achieve flowable high active betaine solutions.

Thus, the process described herein generates high active aqueous betaine composition of Formula I with a composition characterized by solids content of minimum 45% by weight, clear flowing liquid, active betaine content of 35% minimum, sodium chloride content of 6% minimum, free fatty acid content less than 1%, free amidoamine content less than 1% and free sodium monochloroacetate and 3-N,N-dimethylaminopropylamine content less than 5 ppm, solidification point less than 5° C. and cloud point above 35° C.

The betaine composition of the present invention with minimum of 45% solids were subjected to microbial 'challenge test' using following microorganisms.

A] *Staphylococcus aureus*
B] *Escherichia coli*
C] *Pseudomonas aeruginosa*
D] *Candida albicans*
E] *Aspergillus niger*

The high active betaine samples with solids content of 45% minimum were inoculated by $1.0\times10^5$-$1.0\times10^6$ cfu/ml organisms of each of the above mentioned. The microbial counts of all the composition of betaines having solids content of at least 45% by weight were found to be less than 10 cfu/ml after 7 days.

| | Microbial count cfu/ml | | | |
|---|---|---|---|---|
| Microorganism | 0 hours | 24 hours | 7 days | 14 days |
| *Staphylococcus aureus* ATCC 6538 | $2.0 \times 10^6$ | <400 | <10 | <10 |
| *Escherichia coli* ATCC 10148 | $5.0 \times 10^5$ | <400 | <10 | <10 |
| *Pseudomonas aeruginosa* (In-house isolate) | <400 | <20 | <10 | <10 |
| *Candida albicans* ATCC 10231 | $1.28 \times 10^6$ | $1.04 \times 10^5$ | <10 | <10 |
| *Aspergillus niger* ATCC 16404 | $5.7 \times 10^4$ | $5.6 \times 10^3$ | <10 | <10 |

The high active betaine composition of the present invention has the following advantages As described in the background, N-acyl α-amino acid of Formula III is much more useful additive than those described in the prior art.

The process of the present invention circumvents steps like filtration, concentration and use of organic solvents for making high active betaines.

High active betaine composition of the present invention are self-preserving.

The process yields high active betaine composition with less than 5.0 ppm of free sodium monochloroacetate, a totally undesirable impurity.

The following examples describe in detail the process and the betaine composition of the present invention. These examples are by way of illustrations only and in no way restrict the scope of the invention.

EXAMPLES

Cocofatty acid amidoamine was prepared from cocofatty acid and 3-N,N-dimethylaminopropylamine. 3-N,N-Dimethylaminopropylamine was procured from BASF and sodium monochloroacetate was purchased from Clariant.

Example I

To a stirred mixture of cocofatty acid amidoamine (300 g, 1.0 mole, tertiary nitrogen content of 4.79%, acid value 7.3), glycerin (31.5 g) and water (320 ml) under nitrogen at 65° C., an aqueous solution of sodium monochloroacetate (311.6 g, 40%, 1.07 moles) was added over the period of half an hour. The reaction mixture was stirred for 8 hours at 80-85° C. by maintaining the pH between 7.5 to 8.2 with sodium hydroxide (47% aqueous solution). Cocoyl glycine (6 g) was then added to the reaction mixture and stirring was continued for 8 hours at 95° C. while maintaining pH between 10-10.5. The reaction mass was cooled and the pH was adjusted to 4.5 to 5.5 with hydrochloric acid. The clear product (982 g) so formed had the following composition.

| | |
|---|---|
| Solids | 47.2% |
| Betaine | 35.2% |
| NaCl | 6.9% |
| Fatty acids | 0.8% |
| Cocoyl glycine | 0.6% |
| Glycerin | 3.2% |
| Amidoamine | 0.1% |
| Sodium monochloroacetate | <5.0 ppm |
| pH | 5.2 |
| Cloud point | >40° C. |
| Solidification point | <−7° C. |

Example II

To a stirred mixture of cocofatty acid amidoamine (298 g, 1.0 mole, tertiary nitrogen content of 4.85%, acid value 4.6), glycerin (32.6 g) and water (341 ml) under nitrogen at 65° C., an aqueous solution of sodium monochloroacetate (311.6 g, 40%, 1.07 moles) was added over the period of half an hour. The reaction mixture was stirred for 8 hours at 80-85° C. by maintaining the pH between 7.5 to 8.2 with sodium hydroxide (47% aqueous solution). Lauroyl glycine (9.7 g) was then added to the reaction mixture and stirring was continued for 8 hours at 95° C. while maintaining pH between 10-10.5. The reaction mass was cooled and the pH was adjusted to 4.5 to 5.5 with phosphoric acid. The clear product (991 g) so formed had the following composition.

| | |
|---|---|
| Solids | 47% |
| Betaine | 35.04% |
| NaCl | 6.46% |
| Fatty acids | 0.5% |
| Lauroyl glycine | 1.0% |
| Glycerin | 3.3% |
| Amidoamine | 0.3% |
| Sodium monochloroacetate | <5.0 ppm |
| PH | 5.1 |
| Cloud point | >40° C. |
| Solidification point | <3° C. |

Example III

To a stirred mixture of cocofatty acid amidoamine (298 g, 1.0 mole, tertiary nitrogen content of 4.85%, acid value 4.6), glycerin (31.5 g) and water (331 ml) under nitrogen at 65° C., an aqueous solution of sodium monochloroacetate (311.6 g, 40%, 1.07 moles) was added over the period of half an hour. The reaction mixture was stirred for 8 hours at 80-85° C. by maintaining the pH between 7.5 to 8.2 with sodium hydroxide (47% aqueous solution). Oleoyl glycine (9.7 g) was then added to the reaction mixture and stirring was continued for 8 hours at 95° C. while maintaining pH between 10-10.5. The reaction mass was cooled and the pH was adjusted to 4.5 to 5.5 with phosphoric acid. The clear product (987 g) so formed had the following composition.

| | |
|---|---|
| Solids | 47.0% |
| Betaine | 35.23% |
| NaCl | 6.44% |
| Fatty acids | 0.48% |
| Oleoyl glycine | 1.0% |
| Glycerin | 3.2% |

-continued

| | |
|---|---|
| Amidoamine | 0.25% |
| Sodium monochloroacetate | <5.0 ppm |
| PH | 5.11 |
| Cloud point | >40° C. |

Example IV

To a stirred mixture of cocofatty acid amidoamine (300 g, 1.0 mole, tertiary nitrogen content of 4.79%, acid value 7.3), glycerin (32.5 g) and water (365 ml) under nitrogen at 65° C., an aqueous solution of sodium monochloroacetate (311.6 g, 40%, 1.07 moles) was added over the period of half an hour. The reaction mixture was stirred for 8 hours at 80-85° C. by maintaining the pH between 7.5 to 8.2 with sodium hydroxide (47% aqueous solution). Lauroyl sarcosine (6.1 g) was then added to the reaction mixture and stirring was continued for 8 hours at 95° C. while maintaining pH between $10^{-10.5}$. The reaction mass was cooled and the pH was adjusted to 4.5 to 5.5 with phosphoric acid. The clear product (1020 g) so formed had the following composition.

| | |
|---|---|
| Solids | 45.4% |
| Betaine | 34.21% |
| NaCl | 6.34% |
| Fatty acids | 0.8% |
| Lauroyl sarcosine | 0.6% |
| Glycerin | 3.2% |
| Amidoamine | 0.25% |
| Sodium monochloroacetate | <5.0 ppm |
| PH | 4.9 |
| Cloud point | >40° C. |
| Solidification point | <5° C. |

Example V

To a stirred mixture of cocofatty acid amidoamine (300 g, 1.0 mole, tertiary nitrogen content of 4.79%, acid value 7.3), glycerin (30.7 g) and water (300 ml) under nitrogen at 65° C., an aqueous solution of sodium monochloroacetate (311.6 g, 40%, 1.07 moles) was added over the period of half an hour. The reaction mixture was stirred for 8 hours at 80-85° C. by maintaining the pH between 7.5 to 8.2 with sodium hydroxide (47% aqueous solution). Cocoyl glycine (6 g) was then added to the reaction mixture and stirring was continued for 8 hours at 95° C. while maintaining pH between 10-10.5. The reaction mass was cooled and the pH was adjusted to 4.5 to 5.5 with phosphoric acid. The clear product (961 g) so formed had the following composition.

| | |
|---|---|
| Solids | 48.28% |
| Betaine | 35.93% |
| NaCl | 7.0% |
| Fatty acids | 0.8% |
| Cocoyl glycine | 0.6% |
| Glycerin | 3.2% |
| Amidoamine | 0.25% |
| Sodium monochloroacetate | <5.0 ppm |
| PH | 4.8 |
| Cloud point | >40° C. |
| Solidification point | <−3° C. |

We claim:

1. An aqueous betaine composition comprising, a betaine of Formula I,

Formula I

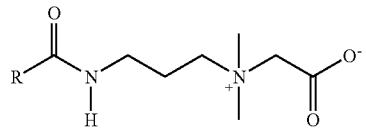

wherein, R is an alkyl group of coconut fatty acids, preferably hydrogenated coconut fatty acids, or a fatty acid mixture which, on the average, corresponds to coconut fatty acids, an amidoamine of not more than 1% by weight, a free fatty acid less than 1% by weight, 0 to 4% by weight of glycerin, based on composition, less than 5 ppm of free sodium monochloroacetate and, 0.5 to 3% by weight of N-acyl α-amino acids of Formula III wherein R' is selected from saturated or unsaturated alkyl group with carbon atoms from 8 to 20 and R" is selected from H, methyl, ethyl or phenyl, Formula III

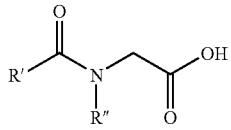

wherein the composition has a solids content of at least 45% by weight, a minimum of 35% by weight of active betaine, and a pH of 4.5 to 8.

2. An aqueous betaine composition comprising a betaine of Formula I,

Formula I

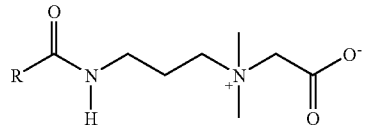

wherein, R is hydrogenated coconut fatty acid, up to 1.0% by weight of an amidoamine, 0.9% by weight of a free fatty acid, 3.0% by weight of glycerin, less than 5 ppm of free sodium monochloroacetate and, 0.6% by weight is of N-cocoyl glycine of Formula III, wherein R' is cocofatty acid and R" is H, Formula III

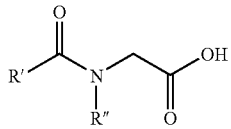

wherein the composition has a solids content of at least 45% by weight, a minimum of 35% by weight of active betaine, and a pH of 4.5 to 8.

3. The aqueous betaine composition of Formula I as claimed in claim 1, wherein the coconut fatty acid is selected from hydrogenated coconut fatty acids, a fatty acid mixture or a mixture thereof which, on the average, corresponds to coconut fatty acids.

4. A process for preparing an aqueous composition comprising a betaine of Formula I, Formula I

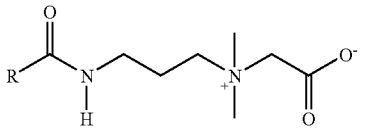

wherein, R is an alkyl group of coconut fatty acids, or a fatty acid mixture which, on the average, corresponds to coconut fatty acids, an amidoamine of not more than 1% by weight, a free fatty acid less than 1% by weight, 0 to 4% by weight of glycerin, based on composition, less than 5 ppm of free sodium monochloroacetate and, 0.5 to 3% by weight of N-acyl α-amino acids of Formula III wherein R' is selected from saturated or unsaturated alkyl group with carbon atoms from 8 to 20 and R" is selected from H, methyl, ethyl or phenyl, Formula III

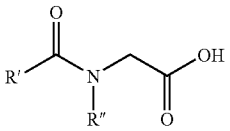

wherein the composition has a solids content of at least 45% by weight and a pH of 4.5 to 8, said process comprising quatemisation of amidoamine of Formula II, Formula II

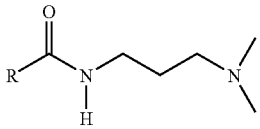

wherein, R is an alkyl group of coconut fatty acids or a fatty acid mixture which, on the average, corresponds to coconut fatty acids alkyl group, with sodium salt of monochloroacetic acid at 80-85° C. while maintaining the pH between 7.5 to 8.5 by adding concentrated solution of sodium hydroxide; adding N-acyl α-aminoacids of Formula III, in an amount 0.5 to 3% by weight; raising the pH to between 10 to 10.5 and reaction is continued at a temperature of between 90-98° C. for a period of 4-8 hours and thercafter adjusting the pH to 4.5 to 6.0 with a mineral acid.

5. The aqueous betaine composition of claim 1; wherein said aqueous betaine composition is a pourable and flowable liquid at ambient temperatures.

6. The aqueous betaine composition of claim 1, wherein the composition has a solidification point of less than 5° C.

7. The aqueous betaine composition of claim 1, wherein the composition has a cloud point above 35° C.

8. The aqueous betaine composition of claim 2, wherein said aqueous betaine composition is a pourable and flowable liquid at ambient temperatures.

9. The aqueous betaine composition of claim 2, wherein the composition has a solidification point of less than 5° C.

10. The aqueous betaine composition of claim 2, wherein the composition has a cloud point above 35° C.

11. The aqueous betaine composition of claim 1, wherein the pH is 4.5 to 6.5.

12. The aqueous betaine composition of claim 1, wherein the pH is 4.5 to 5.5.

13. The aqueous betaine composition of claim 2, wherein the pH is 4.5 to 6.5.

14. The aqueous betaine composition of claim 2, wherein the pH is 4.5 to 5.5.

* * * * *